US007187114B2

(12) United States Patent
Takeuchi et al.

(10) Patent No.: US 7,187,114 B2
(45) **Date of Patent: *Mar. 6, 2007**

(54) ELECTRON EMITTER COMPRISING EMITTER SECTION MADE OF DIELECTRIC MATERIAL

(75) Inventors: Yukihisa Takeuchi, Nishikamo-Gun (JP); Tsutomu Nanataki, Toyoake (JP); Iwao Ohwada, Nagoya (JP)

(73) Assignee: NGK Insulators, Ltd., Nagoya City (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/459,110

(22) Filed: Jun. 11, 2003

(65) Prior Publication Data

US 2004/0104684 A1 Jun. 3, 2004

Related U.S. Application Data

(63) Continuation-in-part of application No. 10/405,955, filed on Apr. 2, 2003, now abandoned.

(30) Foreign Application Priority Data

Nov. 29, 2002 (JP) ..... 2002-348900
May 30, 2003 (JP) ..... 2003-154528

(51) Int. Cl.
*H01J 1/62* (2006.01)

(52) U.S. Cl. ..... 313/495; 313/508; 313/509

(58) Field of Classification Search ..... 315/169.3, 315/169.1, 167; 313/495, 496, 309, 310, 313/306, 508–509, 346 R; 445/3, 23, 49–51, 445/66–67

See application file for complete search history.

(56) References Cited

U.S. PATENT DOCUMENTS 5,280,221 A 1/1994 Okamoto et al. ..... 315/169.1
5,382,867 A 1/1995 Maruo et al. ..... 313/309

(Continued)

FOREIGN PATENT DOCUMENTS

DE 3833604 4/1990

(Continued)

OTHER PUBLICATIONS

"Pulsed Electron Source Using a Ferroelectric Cathode," Tokyo Institute of Technology, vol. 68, No. 5, Jan. 7, 1999, pp. 546-550.

(Continued)

*Primary Examiner*—Thuy Vinh Tran
(74) *Attorney, Agent, or Firm*—Burr & Brown

(57) ABSTRACT

An electron emitter has an emitter section formed on a substrate, and a cathode electrode and an anode electrode formed on a same surface of the emitter section. A slit is formed between the cathode electrode and the anode electrode. A drive voltage from a pulse generation source is applied between the anode electrode and the cathode electrode. The anode electrode is connected to the ground. A charging film is formed on a surface of the anode electrode.

22 Claims, 16 Drawing Sheets

U.S. PATENT DOCUMENTS

| | | | | |
|---|---|---|---|---|
| 5,453,661 | A | 9/1995 | Auciello et al. | 315/169.3 |
| 5,508,590 | A | 4/1996 | Sampayan et al. | 315/169.1 |
| 5,561,340 | A | 10/1996 | Jin et al. | 313/309 |
| 5,656,887 | A | 8/1997 | Voshell et al. | 313/496 |
| 5,657,054 | A | 8/1997 | Files et al. | 345/177 |
| 5,666,019 | A | 9/1997 | Potter | 313/306 |
| 5,689,121 | A | 11/1997 | Kitagawa et al. | 257/139 |
| 5,726,524 | A * | 3/1998 | Debe | 313/309 |
| 5,729,094 | A | 3/1998 | Geis et al. | 315/169.1 |
| 5,747,926 | A | 5/1998 | Nakamoto et al. | 313/495 |
| 5,874,802 | A | 2/1999 | Choi et al. | 313/495 |
| 5,877,594 | A | 3/1999 | Miyano et al. | 315/169.1 |
| 5,986,389 | A * | 11/1999 | Tsukamoto | 313/310 |
| 5,990,605 | A | 11/1999 | Yoshikawa et al. | 313/310 |
| 6,025,819 | A | 2/2000 | Xie et al. | 345/74 |
| 6,040,973 | A | 3/2000 | Okamoto et al. | 361/235 |
| 6,153,978 | A | 11/2000 | Okamoto | 315/169.3 |
| 6,157,145 | A | 12/2000 | Vollkommer et al. | 315/339 |
| 6,184,610 | B1 | 2/2001 | Shibata et al. | 313/309 |
| 6,184,612 | B1 | 2/2001 | Negishi et al. | 313/310 |
| 6,198,225 | B1 | 3/2001 | Kano et al. | 315/169.3 |
| 6,274,881 | B1 | 8/2001 | Akiyama et al. | 257/10 |
| 6,285,123 | B1 | 9/2001 | Yamada et al. | 313/495 |
| 6,306,001 | B1 * | 10/2001 | Hiroki | 445/6 |
| 6,313,815 | B1 | 11/2001 | Takeda et al. | 345/75.2 |
| 6,359,383 | B1 * | 3/2002 | Chuang et al. | 313/496 |
| 6,420,822 | B1 | 7/2002 | Symons | 313/346 R |
| 6,452,328 | B1 * | 9/2002 | Saito et al. | 313/495 |
| 6,469,452 | B2 | 10/2002 | Seo et al. | 315/169.4 |
| 6,479,924 | B1 | 11/2002 | Yoo | 313/310 |
| 6,514,891 | B1 | 2/2003 | Lee | 501/32 |
| 6,580,108 | B1 | 6/2003 | Utsumi et al. | 257/288 |
| 6,762,541 | B1 | 7/2004 | Yamamoto et al. | 313/306 |
| 6,827,619 | B2 * | 12/2004 | Oda et al. | 445/6 |
| 2002/0060516 | A1 * | 5/2002 | Kawate et al. | 313/495 |
| 2002/0153827 | A1 | 10/2002 | Takeuchi et al. | 313/495 |

FOREIGN PATENT DOCUMENTS

| | | | |
|---|---|---|---|
| DE | 10057072 | | 5/2001 |
| EP | 0 353 632 | | 2/1990 |
| EP | 428853 | | 5/1991 |
| EP | 0 628 982 | | 12/1994 |
| EP | 0 953 958 | A2 | 11/1999 |
| EP | 1 265 263 | | 12/2002 |
| FR | 2639151 | | 5/1990 |
| FR | 2675306 | | 10/1992 |
| FR | 2789221 | | 8/2000 |
| FR | 2789223 | | 8/2000 |
| JP | 44-26125 | | 11/1969 |
| JP | 46-20944 | | 6/1971 |
| JP | 59-208587 | | 11/1984 |
| JP | 63-150837 | A | 6/1988 |
| JP | 01-107440 | | 4/1989 |
| JP | 1-311533 | A | 12/1989 |
| JP | 05-325777 | | 12/1993 |
| JP | 7-147131 | A | 6/1995 |
| JP | 08-111166 | | 4/1996 |
| JP | 08-264105 | | 10/1996 |
| JP | 09-090882 | A | 4/1997 |
| JP | 10-27539 | A | 1/1998 |
| JP | 10-223129 | | 8/1998 |
| JP | 11-185600 | | 7/1999 |
| JP | 11-288249 | A | 10/1999 |
| JP | 2000-268709 | | 9/2000 |
| JP | 2000-285801 | A | 10/2000 |
| JP | 2000-310970 | A | 11/2000 |
| JP | 2000-323017 | | 11/2000 |
| JP | 2001-015840 | | 1/2001 |
| JP | 3160213 | B2 | 2/2001 |
| JP | 3168353 | | 3/2001 |
| JP | 3214256 | | 7/2001 |
| JP | 2002-124178 | | 4/2002 |
| WO | 02/052600 | A1 | 7/2002 |

OTHER PUBLICATIONS

Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633-5637.

Riege, H., "Electron Emission from Ferroelectrics—a Review," Nucl. Instr. and Meth. A340, 1994, pp. 80-89.

Masatoshi Miyake et al., "*Electron Emission from Ferroelectric Cathodes Excited by Pulsed Voltage*," Tokyo Institute of Technology, vol. 119, No. 5, 1999 pp. 622-627.

U.S. Appl. No. 10/374,955, filed Feb. 25, 2003, Takeuchi et al.

U.S. Appl. No. 10/459,415, filed Jun. 11, 2003, Takeuchi et al.

U.S. Appl. No. 10/459,416, filed Jun. 11, 2003, Takeuchi et al.

U.S. Appl. No. 10/459,386, filed Jun. 11, 2003, Takeuchi et al.

U.S. Appl. No. 10/647,794, filed Aug. 25, 2003, Takeuchi et al.

U.S. Appl. No. 10/673,384, filed Sep. 26, 2003, Takeuchi et al.

U.S. Appl. No. 10/671,763, filed Sep. 26, 2003, Takeuchi et al.

U.S. Appl. No. 10/678,958, filed Oct. 3, 2003, Takeuchi et al.

U.S. Appl. No. 10/699,186, filed Oct. 31, 2003, Takeuchi et al.

U.S. Appl. No. 10/719,521, filed Nov. 21, 2003, Takeuchi et al.

U.S. Appl. No. 10/719,596, filed Nov. 21, 2003, Takeuchi et al.

U.S. Appl. No. 10/730,754, filed Dec. 8, 2003, Takeuchi et al.

U.S. Appl. No. 10/731,901, filed Dec. 9, 2003, Takeuchi et al.

G. Benedek et al., "Electron Emission From Ferroelectric/Antiferroelectric Cathodes Excited by Short High-Voltage Pulses", Journal Applied Physics, vol. 81, No. 3, Feb. 1, 1997, pp. 1396-1403.

Gundel, H. et al., "Low Pressure Hollow Cathode Switch Triggered by a Pulsed Electron Beam Emitted From Ferroelectrics", Applied Physics Letter, American Institute of Physics, New York, US vol. 54, No. 21, May 22, 1989, pp. 2071-2073.

Gundel, H. et al., "Time-Dependent Electron Emission From Ferroelectrics by External Pulsed Electric Fields", Journal of Applied Physics, American Institute of Physics, New York, US vol. 69, No. 2, Jan. 15, 1991, pp. 975-982.

U.S. Appl. No. 10/808,258, filed Mar. 24, 2004, Takeuchi et al.

U.S. Appl. No. 10/951,509, filed Sep. 28, 2004, Takeuchi et al.

U.S. Appl. No. 10/950,976, filed Sep. 27, 2004, Takeuchi et al.

U.S. Appl. No. 10/952,524, filed Sep. 28, 2004, Takeuchi et al.

U.S. Appl. No. 10/951,832, filed Sep. 28, 2004, Takeuchi et al.

Kanemaru, Seigou, "Featuring: All About Flat Displays 2000, Leading Technological Trend of FEDs," Electronic Engineering, Nikkan Kogyo Shimbun, Ltd., Jul. 2000, pp. 38-41 (with partial translation).

U.S. Appl. No. 10/919,747, filed Aug. 17, 2001, Takeuchi et al.

U.S. Appl. No. 10/901,932, filed Jul. 29, 2004, Takeuchi et al.

U.S. Appl. No. 10/919,678, filed Aug. 17, 2004, Takeuchi et al.

* cited by examiner

ELECTRON EMITTER COMPRISING EMITTER SECTION MADE OF DIELECTRIC MATERIAL

CROSS REFERENCE TO RELATED APPLICATION

This application is a continuation-in-part application of U.S. application Ser. No. 10/405,955 filed May 02, 2003, which is now abandoned, and claims the benefit of Japanese Application 2002-348900, filed Nov. 29, 2002, and Japanese Application 2003-154528, filed May 30, 2003, the entireties of which are incorporated herein by reference.

BACKGROUND OF THE INVENTION

1. Field of the Invention

The present invention relates to an electron emitter including a first electrode and a second electrode formed on an emitter section. A slit is formed between the first electrode and the second electrode.

2. Description of the Related Art

In recent years, electron emitters having a cathode electrode and an anode electrode have been used in various applications such as field emission displays (FEDs) and backlight units. In an FED, a plurality of electron emitters are arranged in a two-dimensional array, and a plurality of fluorescent elements are positioned at predetermined intervals in association with the respective electron emitters.

Conventional electron emitters are disclosed in Japanese laid-open patent publication No. 1-311533, Japanese laid-open patent publication No. 7-147131, Japanese laid-open patent publication No. 2000-285801, Japanese patent publication No. 46-20944, and Japanese patent publication No. 44-26125, for example. All of these disclosed electron emitters are disadvantageous in that since no dielectric body is employed in the emitter section, a forming process or a micromachining process is required between facing electrodes, a high voltage needs to be applied between the electrodes to emit electrons, and a panel fabrication process is complex and entails a high panel fabrication cost.

It has been considered to make an emitter section of a dielectric material. Various theories about the emission of electrons from a dielectric material have been presented in the documents: Yasuoka and Ishii, "Pulsed electron source using a ferroelectric cathode", J. Appl. Phys., Vol. 68, No. 5, p. 546–550 (1999), V. F. Puchkarev, G. A. Mesyats, "On the mechanism of emission from the ferroelectric ceramic cathode", J. Appl. Phys., Vol. 78, No. 9, 1 Nov., 1995, p. 5633–5637, and H. Riege, "Electron emission ferroelectrics—a review", Nucl. Instr. and Meth. A340, p. 80–89 (1994).

In the conventional electron emitters, electrons trapped on the surface of the dielectric material, at the interface between the dielectric material and the upper electrode, and in the dielectric material by the defect level are released (emitted) when polarization reversal occurs in the dielectric material. The number of the electrons emitted by the polarization reversal does not change substantially depending on the voltage level of the applied voltage pulse.

However, the electron emission is not performed stably, and the number of emitted electrons is merely tens of thousands. Therefore, conventional electron emitters are not suitable for practical use. Advantages of an electron emitter having an emitter section made of a dielectric material have not been achieved.

SUMMARY OF THE INVENTION

It is an object of the present invention to provide an electron emitter having an emitter section made of a dielectric material in which a first electrode is not damaged easily due to the emission of electrons, so that the electron emitter has a long service life and high reliability.

According to the present invention, an electron emitter comprises an emitter section made of a dielectric material, a first electrode formed in contact with the emitter section, and a second electrode formed in contact with the emitter section. A slit is formed between the first electrode and the second electrode. A drive voltage is applied between the first electrode and the second electrode to induce polarization reversal at least at a portion of the emitter section which is exposed through the slit, for emitting electrons. A charging film is formed at least on a surface of the second electrode.

In the electron emitter, the emitter section may be made of a piezoelectric material, an anti-ferroelectric material, or an electrostrictive material.

Polarization reversal may occur in an electric field E of the emitter section represented by E=Vak/d, where d is a width of the slit, and Vak is a voltage applied between the first electrode and the second electrode. In this case, preferably, the voltage Vak is less than a dielectric breakdown voltage of the emitter section. The thickness d may be determined so that the voltage Vak applied between the first electrode and the second electrode has an absolute value of less than 100V.

The principle of exponential increase of electrons in the electron emission, and the affect of the electron emission to the first electrode will be described. Firstly, a drive voltage is applied between the first electrode and the second electrode such that the first electrode has a potential lower than a potential of the second electrode to reverse polarization of at least a portion of the emitter section which is exposed through the slit. The polarization reversal causes emission of electrons in the vicinity of the first electrode. The polarization reversal generates a locally concentrated electric field on the first electrode and the positive poles of dipole moments in the vicinity the first electrode, emitting primary electrons from the first electrode. The primary electrons emitted from the first electrode impinge upon the emitter section, causing the emitter section to emit secondary electrons.

When the first electrode, the portion of the emitter section which is exposed through the slit, and a vacuum atmosphere define a triple point, primary electrons are emitted from a portion of the first electrode in the vicinity of the triple point. The emitted primary electrons impinge upon the emitter section to induce emission of secondary electrons from the emitter section. The secondary electrons include electrons emitted from the solid emitter section under an energy that has been generated by a coulomb collision with primary electrons, Auger electrons, and primary electrons which are scattered in the vicinity of the surface of the emitter section (reflected electrons). In particular, if the first electrode is very thin, having a thickness of 10 nm or less, electrons are emitted from the interface between the first electrode and the emitter section.

Since the electrons are emitted according to the principle as described above, the electron emission is stably performed, and the number of emitted electrons would reach 2 billion or more. Thus, the electron emitter is advantageously used in the practical applications. The number of emitted electrons is increased substantially proportional to the drive voltage applied between the first electrode and the second electrode. Thus, the number of the emitted electrons can be controlled easily.

When the electron emitter is used as a pixel of a display, a third electrode is provided above the emitter section at a position facing the slit. The third electrode is coated with a fluorescent layer. Some of the emitted electrons are guided to the collector electrode to excite the fluorescent layer to emit fluorescent light from the fluorescent layer to the outside. Some of the emitted electrons are guided to the second electrode.

When the emitted electrons are guided to the second electrode, the gas near the second electrode or floating atoms (generated by evaporation of the electrode) near the second electrode are ionized into positive ions and electrons by the emitted electrons. The electrons generated by the ionization ionize the gas and the atoms of the electrode. Therefore, the electrons are increased exponentially to generate a local plasma in which the electrons and the positive ions are neutrally present.

Then, the voltage Vak applied between the first electrode and the second electrode is decreased at the time of electron emission to a level in which electric discharge is maintained in a substantially short circuited condition.

The positive ions generated by the ionization may impinge upon the first electrode, possibly damaging the first electrode.

In order to solve the problem, in the present invention, a charging film is formed at least on a surface of the second electrode. As described above, when some of the electrons emitted from the emitter section are guided toward the second electrode, the surface of the charging film is charged negatively. Therefore, the positive polarity of the second electrode is weakened, and the intensity of the electric field between the first electrode and the second electrode is reduced. The ionization stops instantly. The voltage change between the first electrode and the second electrode is very small at the time of the electron emission. Thus, almost no positive ions are generated, preventing the first electrode from being damaged by positive ions. This arrangement is thus effective to increase the service life of the electron emitter.

The charging film may be made of a piezoelectric material, an electrostrictive material, an anti-ferroelectric material, or a material having a low dielectric constant. For example, $SiO_2$, or a metal oxide film such as MgO, or a glass may be used as the material having a low dielectric constant. Alternatively, the charging film may be made of the same dielectric material as that of the emitter section.

Preferably, the charging film formed on the surface of the second electrode has a thickness in the range of 10 nm to 100 μm. If the charging film is too thin, durability of the charging film may not be good and the charging film may have handling problems. If the charging film is too thick, the distance between the first electrode and the second electrode, i.e., the width of the slit is not small. Therefore, sufficient electric field for emitting electrons may not be generated.

A protective film may be formed on the surface of the first electrode. In the electron emitter, the protective film and the charging film may be made of a same material. The protective film may be made of an insulator or a highly resistive conductor having a low sputtering yield and a high evaporation temperature in vacuum. Preferably, the protective film formed on the first electrode has a thickness in the range of 10 nm to 100 nm. If the protective film is too thin, durability of the protective film may not be good and the protective film may have handling problems. If the protective film is too thick, the electrons emitted from the electric field concentration point or the interface between the first electrode and the emitter section may not pass through the protective film.

In the present invention, preferably, the voltage change between the first electrode and the second electrode at the time of electron emission is 20V or less.

In the present invention, the first electrode and the second electrode may be formed on an upper surface of the emitter section, and the slit may be a gap.

The first electrode may be formed in contact with one side of the emitter section, and the second electrode may be formed in contact with the other side of the emitter section such that the emitter section is positioned in the slit.

If the slit is a gap, the width of the slit may be increased due to the damages of the first electrode, and the drive voltage may not be low voltage. Therefore, the emitter section is positioned in the slit so that the width of the slit does not change even if the first electrode is damaged. Consequently, the electron emission is stably performed at a constant voltage, and the electrode has a long service life.

Further, since the emitter section is sandwiched between the two electrodes., the polarization is performed perfectly in the emitter section, and the electron emission is stably performed by the polarization reversal.

In particular, if the emitter section is formed in a tortuous pattern, the area of contact between the first electrode and the emitter section and the area of contact between the second electrode and the emitter section are increased for efficiently emitting electrons.

In one embodiment, the emitter section is provided on an upper surface of a substrate, the first electrode is formed in contact with one side of the emitter section, the second electrode is formed in contact with the other side of the emitter section, the emitter section is formed in the slit, a third electrode is provided above the substrate, and the third electrode is coated with a fluorescent layer.

The above and other objects, features, and advantages of the present invention will become more apparent from the following description of preferred embodiments when taken in conjunction with the accompanying drawings.

DESCRIPTION OF THE PREFERRED EMBODIMENTS

Electron emitters according to embodiments of the present invention will be described below with reference to FIGS. 1 through 16.

Electron emitters according to the embodiments of the present invention can be used in displays, electron beam irradiation apparatus, light sources, alternatives to LEDs, and electronic parts manufacturing apparatus.

Electron beams in an electron beam irradiation apparatus have a high energy and a good absorption capability in comparison with ultraviolet rays in ultraviolet ray irradiation apparatus that are presently in widespread use. Electron emitters are used to solidify insulating films in superposing wafers for semiconductor devices, harden printing inks without irregularities for drying prints, and sterilize medical devices while being kept in packages.

The electron emitters are also used as high-luminance, high-efficiency light sources such as a projector having a high pressure mercury lamp. The electron emitter according to the present embodiment is suitably used as a light source. The light source using the electron emitter according to the present embodiment is compact, has a long service life, has a fast response speed for light emission. The electron emitter does not use any mercury, and the electron emitter is environmentally friendly.

The electron emitters are also used as alternatives to LEDs in indoor lights, automobile lamps, surface light sources for traffic signal devices, chip light sources, and backlight units for traffic signal devices, small-size liquid-crystal display devices for cellular phones.

The electron emitters are also used in apparatus for manufacturing electronic parts, including electron beam sources for film growing apparatus such as electron beam evaporation apparatus, electron sources for generating a plasma (to activate a gas or the like) in plasma CVD apparatus, and electron sources for decomposing gases. The electron emitters are also used as vacuum micro devices such as high speed switching devices operated at a frequency on the order of Tera-Hz, and large current outputting devices. Further, the electron emitters are used suitably as parts of printers, such as light emitting devices for emitting light to a photosensitive drum, and electron sources for charging a dielectric material.

The electron emitters are also used as electronic circuit devices including digital devices such as switches, relays, and diodes, and analog devices such as operational amplifiers. The electron emitters are used for realizing a large current output, and a high amplification ratio.

Figure 1:
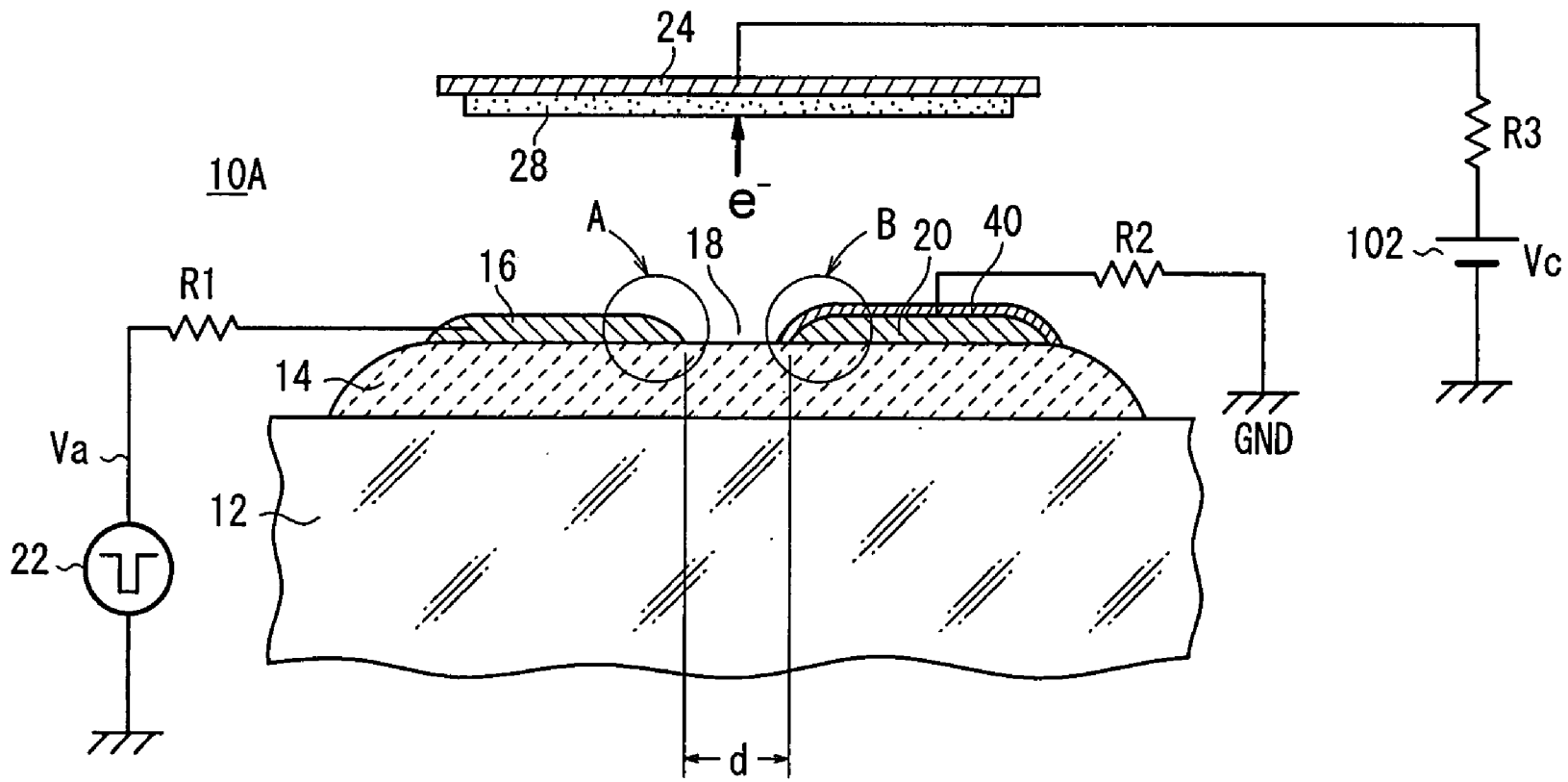
FIG. 1 is a view showing an electron emitter according to a first embodiment.

As shown in FIG. 1, an electron emitter 10A according to the first embodiment comprises an emitter section 14 formed on a substrate 12, a first electrode (cathode electrode) 16 and a second electrode (anode electrode) 20 formed on one surface of the emitter section 14. A slit 18 is formed between the cathode electrode 16 and the anode electrode 20. A pulse generation source 22 applies a drive voltage Va between the cathode electrode 16 and the anode electrode 20 through a resistor R1. In FIG. 1, the anode electrode 20 is connected to GND (ground) and hence set to a zero potential. However, the anode electrode 20 may be set to a potential other than the zero potential.

For using the electron emitter 10A as a pixel of a display, a third electrode (collector electrode) 24 is provided above the emitter section 14 at a position facing the slit 18, and the collector electrode 24 is coated with a fluorescent layer 28. A bias voltage source 102 (having a bias voltage Vc) is connected to the collector electrode 24 through a resistor R3.

The electron emitter 10A according to the first embodiment is placed in a vacuum space. As shown in FIG. 1, the electron emitter 10A has electric field concentration points A, B. The point A can also be defined as a triple point where the cathode electrode 16, the emitter section 14, and a vacuum are present at one point. The point B can also be defined as a triple point where the anode electrode 20, the emitter section 14, and a vacuum are present at one point.

The vacuum level in the atmosphere should preferably in the range from $10^2$ to $10^{-6}$ Pa and more preferably in the range from $10^{-3}$ to $10^{-5}$ Pa.

The range of the vacuum level is determined for the following reason. In a lower vacuum, (1) many gas molecules would be present in the space, and a plasma can easily be generated and, if the plasma were generated excessively, many positive ions would impinge upon the cathode electrode 16 and damage the cathode electrode 16, and (2) emitted electrons would impinge upon gas molecules prior to arrival at the collector electrode 24, failing to sufficiently excite the fluorescent layer 28 with electrons that are sufficiently accelerated under the collector potential (bias voltage Vc).

In a higher vacuum, though electrons are smoothly emitted from the electric field concentration points A and B, structural body supports and vacuum seals would be large in size, posing difficulty in making a small electron emitter.

The emitter section 14 is made of a dielectric material. The dielectric material should preferably have a high relative dielectric constant (relative permittivity), e.g., a dielectric constant of 1000 or higher. Dielectric materials of such a nature may be ceramics including barium titanate, lead zirconate, lead magnesium niobate, lead nickel niobate, lead zinc niobate, lead manganese niobate, lead magnesium tantalate, lead nickel tantalate, lead antimony stannate, lead titanate, lead magnesium tungstenate, lead cobalt niobate, etc. or a material whose principal component contains 50 weight % or more of the above compounds, or such ceramics to which there is added an oxide of lanthanum, calcium, strontium, molybdenum, tungsten, barium, niobium, zinc, nickel, manganese, or the like, or a combination of these materials, or any of other compounds.

For example, a two-component material nPMN-mPT (n, m represent molar ratios) of lead magnesium niobate (PMN) and lead titanate (PT) has its Curie point lowered for a larger relative dielectric constant at room temperature if the molar ratio of PMN is increased.

Particularly, a dielectric material where n=0.85 to 1.0 and m=1.0−n is preferable because its relative dielectric constant is 3000 or higher. For example, a dielectric material where n=0.91 and m=0.09 has a relative dielectric constant of 15000 at room temperature, and a dielectric material where n=0.95 and m=0.05 has a relative dielectric constant of 20000 at room temperature.

For increasing the relative dielectric constant of a three-component dielectric material of lead magnesium niobate (PMN), lead titanate (PT), and lead zirconate (PZ), it is preferable to achieve a composition close to a morphotropic phase boundary (MPB) between a tetragonal system and a quasi-cubic system or a tetragonal system and a rhombohedral system, as well as to increase the molar ratio of PMN. For example, a dielectric material where PMN:PT:PZ=0.375:0.375:0.25 has a relative dielectric constant of 5500, and a dielectric material where PMN:PT:PZ=0.5:0.375:0.125 has a relative dielectric constant of 4500, which is particularly preferable. Furthermore, it is preferable to increase the dielectric constant by introducing a metal such as platinum into these dielectric materials within a range to keep them insulative. For example, a dielectric material may be mixed with 20 weight % of platinum.

The emitter section 14 may be in the form of a piezoelectric/electrostrictive layer or an anti-ferroelectric layer. If the emitter section 14 is a piezoelectric/electrostrictive layer, then it may be made of ceramics such as lead zirconate, lead magnesium niobate, lead nickel niobate, lead zinc niobate, lead manganese niobate, lead magnesium tantalate, lead nickel tantalate, lead antimony stannate, lead titanate, barium titanate, lead magnesium tungstenate, lead cobalt niobate, or the like or a combination of any of these materials.

The emitter section 14 may be made of chief components including 50 weight % or more of any of the above compounds. Of the above ceramics, the ceramics including lead zirconate is most frequently used as a constituent of the piezoelectric/electrostrictive layer of the emitter section 14.

If the piezoelectric/electrostrictive layer is made of ceramics, then oxides of lanthanum, calcium, strontium, molybdenum, tungsten, barium, niobium, zinc, nickel, manganese, or the like, or a combination of these materials, or any of other compounds may be added to the ceramics.

For example, the piezoelectric/electrostrictive layer should preferably be made of ceramics including as chief components lead magnesium niobate, lead zirconate, and lead titanate, and also including lanthanum and strontium.

The piezoelectric/electrostrictive layer may be dense or porous. If the piezoelectric/electrostrictive layer is porous, then it should preferably have a porosity of 40% or less.

If the emitter section 14 is in the form of an anti-ferroelectric layer, then the anti-ferroelectric layer may be made of lead zirconate as a chief component, lead zirconate and lead stannate as chief components, lead zirconate with lanthanum oxide added thereto, or lead zirconate and lead stannate as components with lead zirconate and lead niobate added thereto.

The anti-ferroelectric layer may be porous. If the anti-ferroelectric layer is porous, then it should preferably have a porosity of 30% or less.

Strontium bismuthate tantalate is used suitably for the emitter section 14. The emitter section 14 made of strontium bismuthate tantalate is not damaged by the polarization reversal easily. For preventing damages due to the polarization reversal, lamellar ferroelectric compounds represented by a general formula $(BiO_2)^{2+}(A_{m-1}B_mO_{3m+1})^{2-}$ are used. The ionized metal A includes $Ca^{2+}$, $Sr^{2+}$, $Ba^{2+}$, $Pb^{2+}$, $Bi^{3+}$, $La^{3+}$, and the ionized metal B includes $Ti^{4+}$, $Ta^{5+}$, $Nb^{5+}$.

Piezoelectric/electrostrictive/anti-ferroelectric ceramics is mixed with glass components such as lead borosilicate glass or other compounds having a low melting point such as bismuth oxide to lower the firing temperature. Thus, the emitter section 14 is formed easily on the substrate 12.

The emitter section 14 may be made of a material which does not contain any lead, i.e., made of a material having a high melting temperature, or a high evaporation temperature. Thus, the emitter section 14 is not damaged easily when electrons or ions impinge upon the emitter section 14.

The emitter section 14 may be formed on the substrate 12 by any of various thick-film forming processes including screen printing, dipping, coating, electrophoresis, etc., or any of various thin-film forming processes including an ion beam process, sputtering, vacuum evaporation, ion plating, chemical vapor deposition (CVD), plating, etc.

In the first embodiment, the emitter section 14 is formed on the substrate 12 suitably by any of various thick-film forming processes including screen printing, dipping, coating, electrophoresis, etc.

These thick-film forming processes are capable of providing good piezoelectric operating characteristics as the emitter section 14 can be formed using a paste, a slurry, a suspension, an emulsion, a sol, or the like which is chiefly made of piezoelectric ceramic particles having an average particle diameter ranging from 0.01 to 5 μm, preferably from 0.05 to 3 μm.

In particular, electrophoresis is capable of forming a film at a high density with high shape accuracy, and has features described in technical documents such as "Electrochemistry Vol. 53. No. 1 (1985), p. 63–68, written by Kazuo Anzai", and "The 1st Meeting on Finely Controlled Forming of Ceramics Using Electrophoretic Deposition Method, Proceedings (1998), p. 5–6, p. 23–24". The piezoelectric/electrostrictive/anti-ferroelectric material may be formed into a sheet, or laminated sheets. Alternatively, the laminated sheets of the piezoelectric/electrostrictive/anti-ferroelectric material may be laminated on, or attached to another supporting substrate. Any of the above processes may be chosen in view of the required accuracy and reliability.

The width d of the slit 18 between the cathode electrode 16 and the anode electrode 20 is determined so that polarization reversal occurs in the electric field E represented by E=Vak/d (Vak is a voltage measured between the cathode electrode 16 and the anode electrode 20 when the drive voltage Va outputted from the pulse generation source 22 is applied between the cathode electrode 16, and the anode electrode 20). If the width d of the slit 18 is small, the polarization reversal occurs at a low voltage, and electrons are emitted at the low voltage (e.g., less than 100V).

The cathode electrode 16 is made of materials as described below. The cathode electrode 16 should preferably be made of a conductor having a small sputtering yield and a high evaporation temperature in vacuum. For example, materials having a sputtering yield of 2.0 or less at 600V in $Ar^+$ and an evaporation pressure of $1.3\times10^{-3}$ Pa at a temperature of 1800 K or higher are preferable. Such materials include platinum, molybdenum, tungsten, etc. The cathode electrode 16 is made of a conductor which is resistant to a high-temperature oxidizing atmosphere, e.g., a metal, an alloy, a mixture of insulative ceramics and a metal, or a mixture of insulative ceramics and an alloy. Preferably, the cathode electrode 16 should be composed chiefly of a precious metal having a high melting point, e.g., platinum, iridium, palladium, rhodium, molybdenum, or the like, or an alloy of silver and palladium, silver and platinum, platinum and palladium, or the like, or a cermet of platinum and ceramics. Further preferably, the cathode electrode 16 should be made of platinum only or a material composed chiefly of a platinum-base alloy. The electrode should preferably be made of carbon or a graphite-base material, e.g., diamond thin film, diamond-like carbon, or carbon nanotube. Ceramics to be added to the electrode material should preferably have a proportion ranging from 5 to 30 volume %.

Further, preferably, organic metal pastes which produce a thin film after firing, such as platinum resinate paste are used. Further, for preventing damages due to polarization reversal, oxide electrode is used. The oxide electrode is made of any of ruthenium oxide, iridium oxide, strontium ruthenate, $La_{1-x}Sr_xCoO_3$ (e.g., x=0.3 or 0.5), $La_{1-x}Ca_xMnO_3$, $La_{1-x}Ca_xMn_{1-y}Co_yO_3$ (e.g, x=0.2, y=0.05). Alternatively, the oxide electrode is made by mixing any of these materials with platinum resinate paste, for example.

Figure 2:
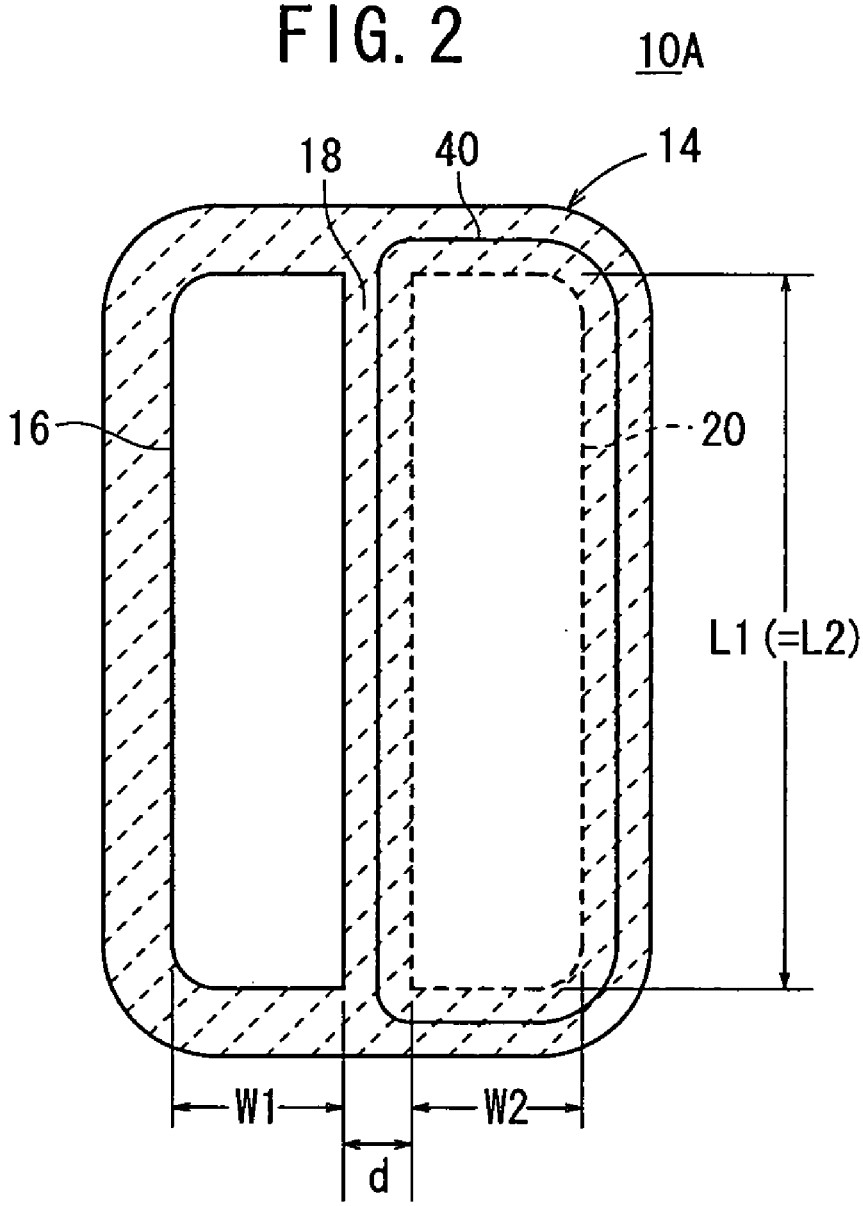
FIG. 2 is a plan view showing electrodes of the electron emitter according to the first embodiment.

The cathode electrode 16 may be made of any of the above materials by an ordinary film forming process which may be any of various thick-film forming processes including screen printing, spray coating, dipping, coating, electrophoresis, etc., or any of various thin-film forming processes including sputtering, an ion beam process, vacuum evaporation, ion plating, CVD, plating, etc. Preferably, the cathode electrode 16 is made by any of the above thick-film forming processes. Dimensions of the cathode electrode 16 will be described with reference to FIG. 2. In FIG. 2, the cathode electrode 16 has a width W1 of 2 mm and a length L1 of 5 mm. Preferably, the cathode electrode 16 has a thickness of 20 μm or less, or more preferably 5 μm or less.

The anode electrode 20 is made of the same material by the same process as the cathode electrode 16. Preferably, the anode electrode 20 is made by any of the above thick-film forming processes. As shown in FIG. 2, as with the cathode electrode 16, the anode electrode 20 has a width W2 of 2 mm and a length L2 of 5 mm.

In the first embodiment, the width d of the slit between the cathode electrode 16 and the anode electrode 20 is 70 μm.

The substrate 12 should preferably be made of an electrically insulative material in order to electrically isolate the line electrically connected to the cathode electrode 16 and the line electrically connected to the anode electrode 20 from each other.

The substrate 12 may be made of a highly heat-resistant metal or a metal material such as an enameled metal whose surface is coated with a ceramic material such as glass or the like. However, the substrate 12 should preferably be made of ceramics.

Ceramics which the substrate 12 is made of include stabilized zirconium oxide, aluminum oxide, magnesium oxide, titanium oxide, spinel, mullite, aluminum nitride, silicon nitride, glass, or a mixture thereof. Of these ceramics, aluminum oxide or stabilized zirconium oxide is preferable from the standpoint of strength and rigidity. Stabilized zirconium oxide is particularly preferable because its mechanical strength is relatively high, its tenacity is relatively high, and its chemical reaction with the cathode electrode 16 and the anode electrode 20 is relatively small. Stabilized zirconium oxide includes stabilized zirconium oxide and partially stabilized zirconium oxide. Stabilized zirconium oxide does not develop a phase transition as it has a crystalline structure such as a cubic system.

Zirconium oxide develops a phase transition between a monoclinic system and a tetragonal system at about 1000° C. and is liable to suffer cracking upon such a phase transition. Stabilized zirconium oxide contains 1 to 30 mol % of a stabilizer such as calcium oxide, magnesium oxide, yttrium oxide, scandium oxide, ytterbium oxide, cerium oxide, or an oxide of a rare earth metal. For increasing the mechanical strength of the substrate 12, the stabilizer should preferably contain yttrium oxide. The stabilizer should preferably contain 1.5 to 6 mol % of yttrium oxide, or more preferably 2 to 4 mol % of yttrium oxide, and furthermore should preferably contain 0.1 to 5 mol % of aluminum oxide.

The crystalline phase may be a mixed phase of a cubic system and a monoclinic system, a mixed phase of a tetragonal system and a monoclinic system, a mixed phase of a cubic system, a tetragonal system, and a monoclinic system, or the like. The main crystalline phase which is a tetragonal system or a mixed phase of a tetragonal system and a cubic system is optimum from the standpoints of strength, tenacity, and durability.

If the substrate 12 is made of ceramics, then the substrate 12 is made up of a relatively large number of crystalline particles. For increasing the mechanical strength of the substrate 12, the crystalline particles should preferably have an average particle diameter ranging from 0.05 to 2 μm, or more preferably from 0.1 to 1 μm.

Each time the emitter section 14, the cathode electrode 16, or the anode electrode 20 is formed, the assembly is heated (sintered) into a structure integral with the substrate 12. After the emitter section 14, the cathode electrode 16, and the anode electrode 20 are formed, they may simultaneously be sintered so that they may simultaneously be integrally coupled to the substrate 12. Depending on the process by which the cathode electrode 16 and the anode electrode 20 are formed, they may not be heated (sintered) so as to be integrally combined with the substrate 12.

The sintering process for integrally combining the substrate 12, the emitter section 14, the cathode electrode 16, and the anode electrode 20 may be carried out at a temperature ranging from 500 to 1400° C., preferably from 1000 to 1400° C. For heating the emitter section 14 which is in the form of a film, the emitter section 14 should be sintered together with its evaporation source while their atmosphere is being controlled.

The emitter section 14 may be covered with an appropriate member for preventing the surface thereof from being directly exposed to the sintering atmosphere when the emitter section 14 is sintered. The covering member should preferably be made of the same material as the substrate 12.

Figure 3:
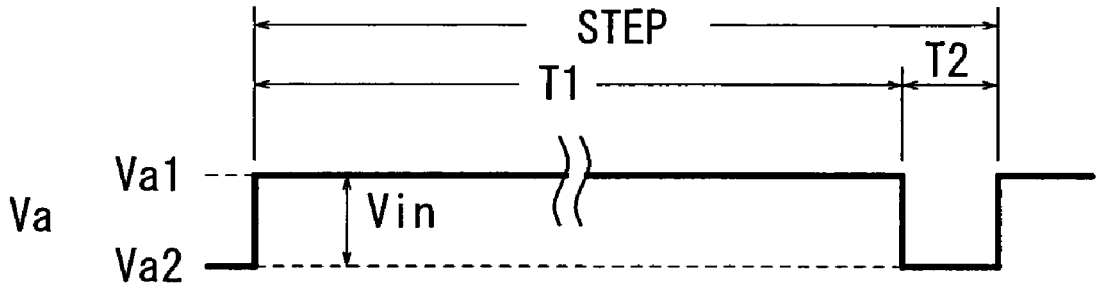
FIG. 3 is a waveform diagram showing a drive voltage outputted from a pulse generation source.

The principles of electron emission of the electron emitter 10A will be described below with reference to FIGS. 1 through 6. As shown in FIG. 3, the drive voltage Va outputted from the pulse generation source 22 has repeated steps each including a period in which a first voltage Va1 is outputted (preparatory period T1) and a period in which a second voltage Va2 is outputted (electron emission period T2). The first voltage Va1 is such a voltage that the potential of the cathode electrode 16 is higher than the potential of the anode electrode 20, and the second voltage Va2 is such a voltage that the potential of the cathode electrode 16 is lower than the potential of the anode electrode 20. The amplitude Vin of the drive voltage Va can be defined as the difference (=Va1−Va2) between the first voltage Va1 and the second voltage Va2.

Figure 4:
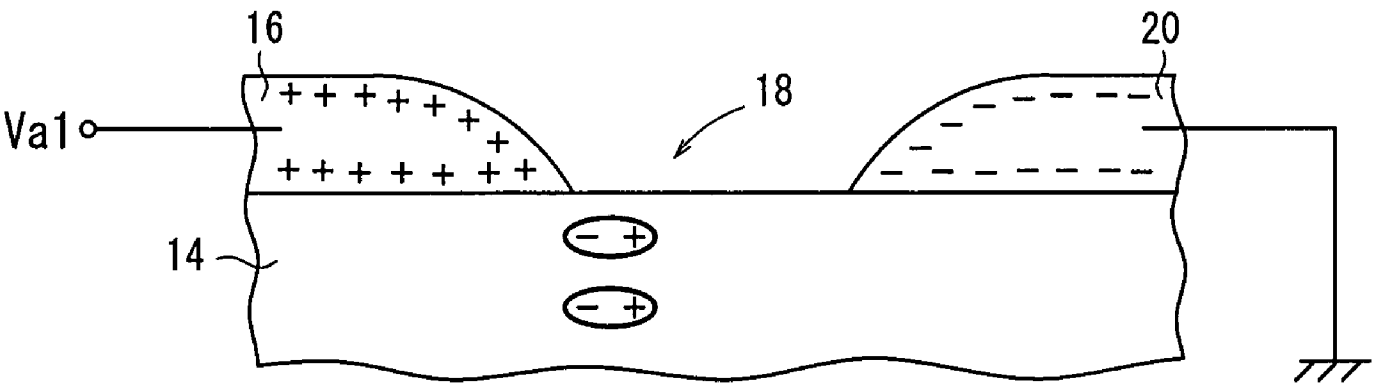
FIG. 4 is a view illustrative of operation when a first voltage is applied between a cathode electrode and an anode electrode.

The preparatory period T1 is a period in which the first voltage Va1 is applied between the cathode electrode 16 and the anode electrode 20 to polarize the emitter section 14, as shown in FIG. 4. The first voltage Va1 may be a DC voltage, as shown in FIG. 3, but may be a single pulse voltage or a succession of pulse voltages. The preparatory period T1 should preferably be longer than the electron emission period T2 for sufficient polarization. For example, the preparatory period T1 should preferably be 100 μsec. or longer. This is because the absolute value of the first voltage Va1 for polarizing the emitter section 14 is smaller than the absolute value of the second voltage Va2 to reduce the power consumption at the time of applying the first voltage Va1, and to prevent the damage of the cathode electrode 16.

Preferably, the voltage levels of the first voltage Va1 and the second voltage Va2 are determined so that the polarization to the positive polarity and the negative polarity can be performed reliably. For example, if the dielectric material of the emitter section 14 has a coercive voltage, preferably, the absolute values of the first voltage Va1 and the second voltage Va2 are the coercive voltage or higher.

Figure 5A:
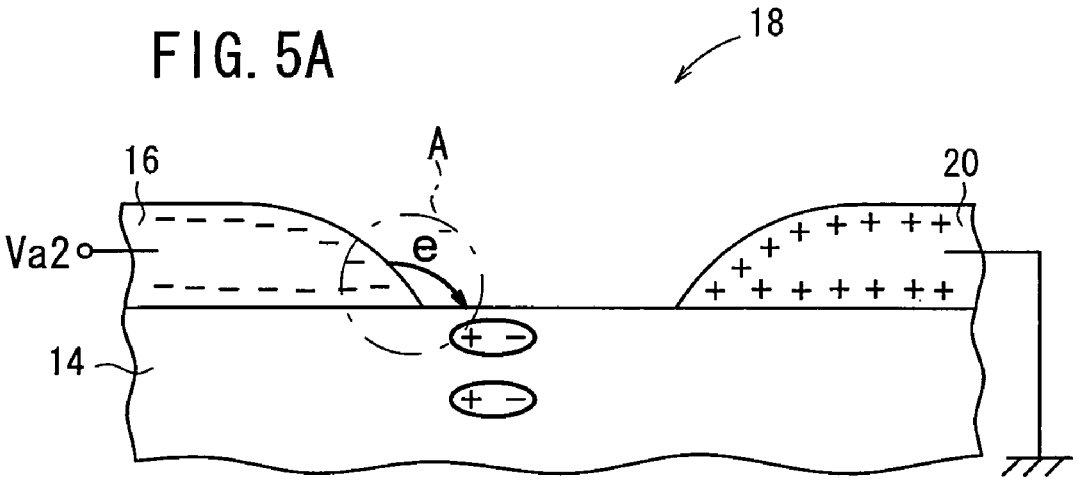
FIG. 5A is a view illustrative of operation of emission of primary electrons when a second voltage is applied between the cathode electrode and the anode electrode.
Figure 5B:
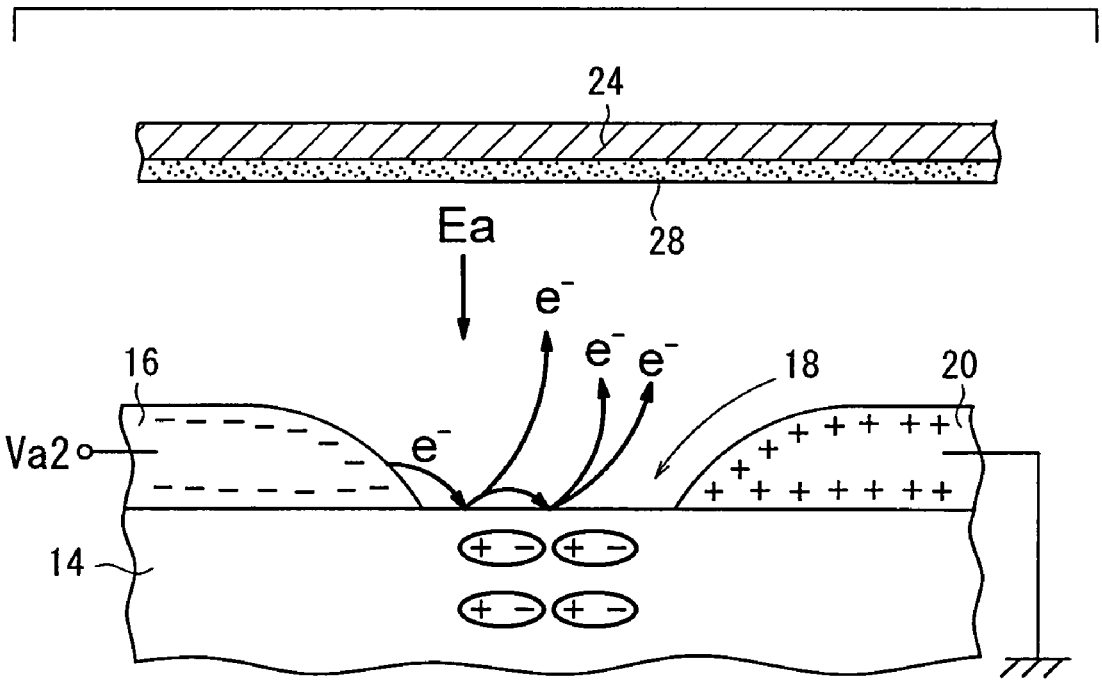
FIG. 5B is a view illustrative of operation of emission of secondary electrons induced by emission of the primary electrons.

The electron emission period T2 is a period in which the second voltage Va2 is applied between the cathode electrode 16 and the anode electrode 20. When the second voltage Va2 is applied between the cathode electrode 16 and the anode electrode 20, as shown in FIG. 5A, the polarization of at least a portion of the emitter section 14 which is exposed through the slit 18 is reversed. Because of the reversed polarization, a locally concentrated electric field is generated on the cathode electrode 16 and the positive poles of dipole moments in the vicinity thereof, emitting primary electrons from the cathode electrode 16. As shown in FIG. 5B, the primary electrons emitted from the cathode electrode 16 impinge upon the emitter section 14, causing the emitter section 14 to emit secondary electrons.

With the electron emitter 10A having the triple point A where the cathode electrode 16, the emitter section 14, and the vacuum are present at one point, primary electrons are emitted from the cathode electrode 16 near the triple point A, and the primary electrons thus emitted from the triple point A impinge upon the emitter section 14, causing the emitter section 14 to emit secondary electrons. If the thickness of the cathode electrode 16 is very small (up to 10 nm), then electrons are emitted from the interface between the cathode electrode 16 and the emitter section 14.

The principle of exponential increase of electrons in the electron emission, and the affect of the electron emission to the cathode electrode 16 will be described. Firstly, when the negative voltage Va2 is applied to the cathode electrode 16, secondary electrons are emitted from the emitter section 14 as described above.

Of the emitted secondary electrons, some are emitted to the collector electrode 24 to excite the fluorescent layer 28, which produces a fluorescent emission directed outwardly. Other secondary electrons and the primary electrons are emitted to the anode electrode 20.

Figure 6:
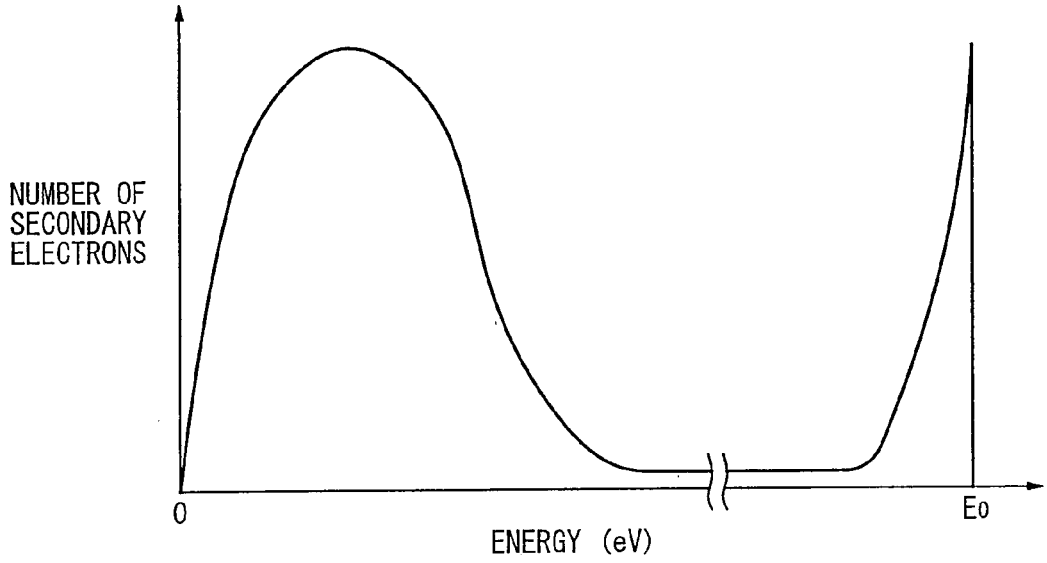
FIG. 6 is a view showing relationship between the energy of the emitted secondary electrons and the number of emitted secondary electrons.

A distribution of emitted secondary electrons will be described below. As shown in FIG. 6, most of the secondary electrons have an energy level near zero. When the secondary electrons are emitted from the surface of the emitter section 14 into the vacuum, they move according to only an ambient electric field distribution. Specifically, the secondary electrons are accelerated from an initial speed of about 0 (m/sec) according to the ambient electric field distribution. Therefore, as shown in FIG. 5B, if an electric field E is generated between the emitter section 14 and the collector electrode 24, the secondary electrons have their emission path determined along the electric field E. Therefore, the electron emitter 10A can serve as a highly straight electron source. The secondary electrons which have a low initial speed are electrons which are emitted from the solid emitter section 14 under an energy that has been generated by a coulomb collision with primary electrons.

As can be seen from FIG. 6, secondary electrons having an energy level which corresponds to the energy $E_0$ of primary electrons are emitted. These secondary electrons are primary electrons that are emitted from the cathode electrode 16 and scattered in the vicinity of the surface of the emitter section 14 (reflected electrons).

If the thickness of the cathode electrode 16 is greater than 10 nm, then almost all of the reflected electrons are directed toward the anode electrode 20. The secondary electrons referred herein include both the reflected electrons and Auger electrons.

If the thickness of the cathode electrode 16 is very small (up to 10 nm), then primary electrons emitted from the cathode electrode 16 are reflected by the interface between the cathode electrode 16 and the emitter section 14, and directed toward the collector electrode 24.

The electrons emitted to the anode electrode 20 ionize a gas or atoms of the anode electrode 20 which are present mainly in the vicinity of the anode electrode 20 into positive ions and electrons. The atoms of the anode electrode 20 are present in the vicinity of the anode electrode 20 as a result of evaporation of part of the anode electrode 20. The atoms float in the vicinity of the anode electrode 20. Since electrons produced by the ionization further ionize the gas and the atoms, the electrons are increased exponentially. As exponential increase of the electrons goes on until electrons and positive ions are present neutrally, a local plasma is generated.

The electrons guided to the anode electrode 20 impinge upon the emitter section 14 for causing emission of secondary electrons. The gas near the anode electrode 20 or the floating atoms (generated by evaporation of the electrode) near the anode electrode 20 are ionized into positive ions and electrons by the emitted electrons.

Figure 7A:
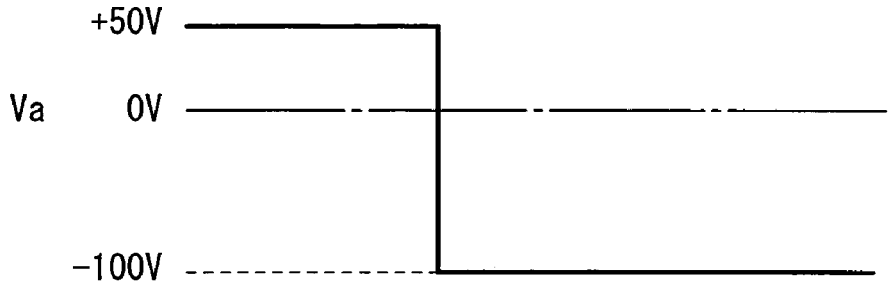
FIG. 7A is a waveform diagram showing an example of a drive voltage.
Figure 7B:
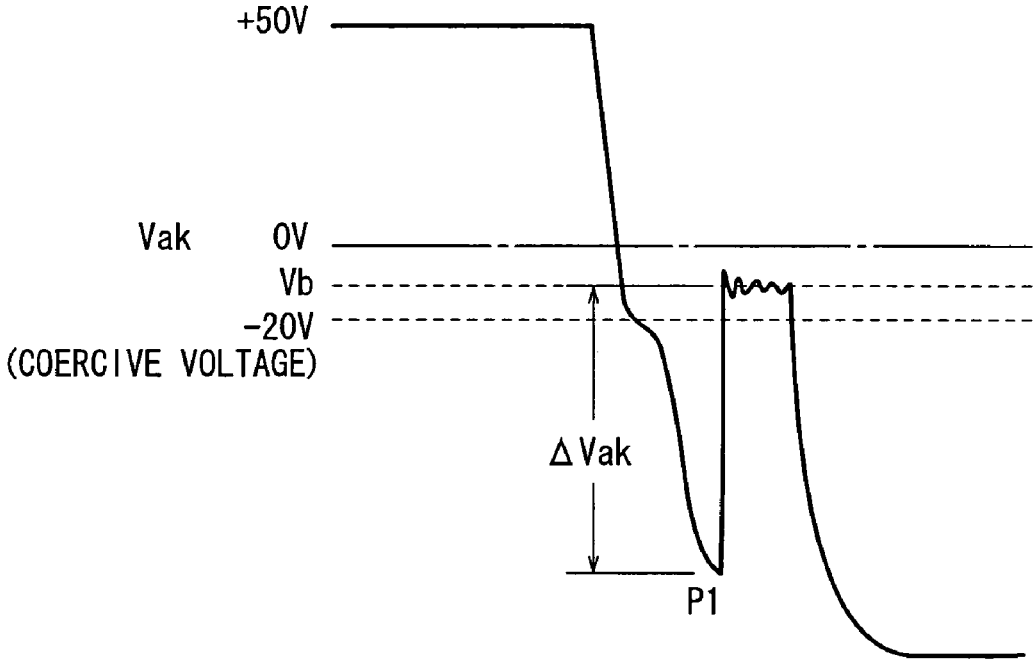
FIG. 7B is a waveform showing the change of the voltage applied between the cathode electrode and the anode electrode in which no charging film is formed on the anode electrode.

As shown in FIG. 7A, for example, the drive voltage Va applied between the cathode electrode 16 and the anode electrode 20 has a first voltage Va1 of 50V, and a second voltage va2 of −100V. In FIG. 7B, the voltage Vak between the cathode electrode 16 and the anode electrode 20 has a peak at the time P1 when electrons are emitted. Then, by the progress of the ionization, the voltage Vak is decreased to a level Vb in which electric discharge is maintained in a substantially short circuited condition. The voltage level Vb may be higher than or smaller than the coercive voltage (e.g., −20V) of the dielectric material (the emitter section 14). The voltage change ΔVak of the voltage between the cathode electrode 16 and the anode electrode 20 is about 50V.

Preferably, the dielectric breakdown voltage of the emitter section 14 is at least 10 kV/mm or higher. In the embodiment, when the width d of the slit 18 is 70 μm, even if the drive voltage of −100V is applied between the cathode electrode 16 and the anode electrode 20, the portion of the emitter section 14 which is exposed through the slit 18 does not break down dielectrically.

The positive ions generated by the ionization may impinge upon the cathode electrode 16, possibly damaging the cathode electrode 16.

Figure 8:
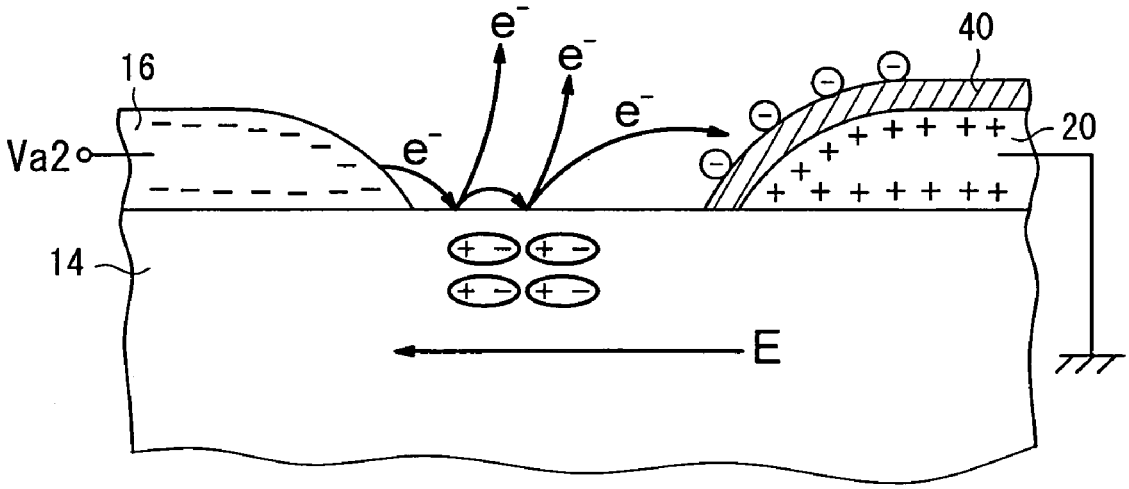
FIG. 8 is a view illustrative of operation when the second voltage is applied between the cathode electrode and the anode electrode of the electron emitter according to the first embodiment.

In order to solve the problem, in the first embodiment, as shown in FIGS. 1 and 8, a charging film 40 is formed on a surface of the anode electrode 20.

Figure 9A:
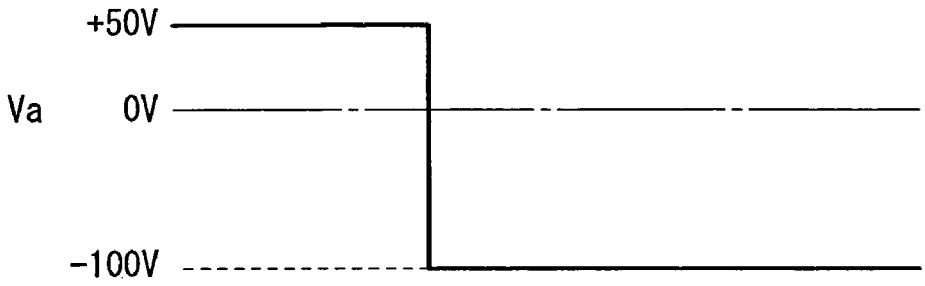
FIG. 9A is a waveform diagram showing an example of a drive voltage.
Figure 9B:
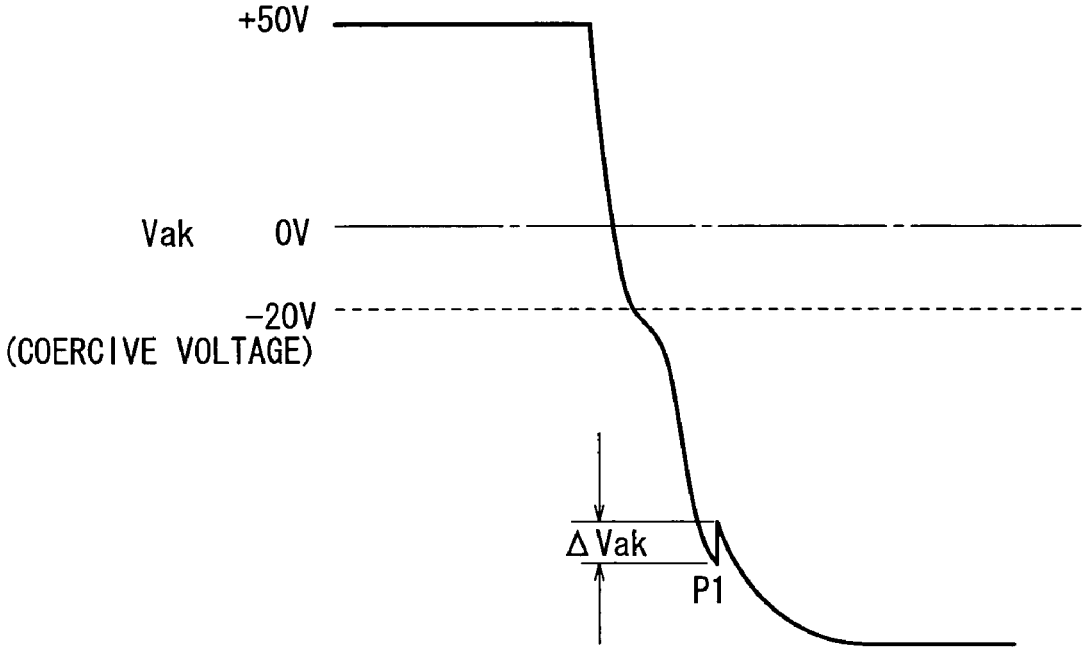
FIG. 9B is a waveform diagram showing the change of the voltage applied between the cathode electrode and the anode electrode of the electron emitter according to the first embodiment.

Thus, when some of the electrons emitted from the emitter section 14 are guided to the anode electrode 20, as shown in FIG. 8, the surface of the charging film 40 is charged negatively. Therefore, the positive polarity of the anode electrode 20 is weakened. and the intensity of the electric field E between the cathode electrode 16 and the anode electrode 20 is reduced. Thus, the ionization stops instantly. In FIG. 9A, for example, the drive voltage Va applied between the cathode electrode 16 and the anode electrode 20 has a first voltage Va1 of 50V, and a second voltage va2 of −100V. The change ΔVak of the voltage between the cathode electrode 16 and the anode electrode 20 at the time P1 (peak) the electrons are emitted is 20V or less (about 10V in the example of FIG. 9B), and very small. Consequently, almost no positive ions are generated, thus preventing the cathode electrode 16 from being damaged by positive ions. This arrangement is thus effective to increase the service life of the electron emitter 10A.

Preferably, the charging film 40 formed on the surface of the anode electrode 20 has a thickness t1 in the range of 10 nm to 100 μm. If the charging film 40 is too thin, durability of the charging film 40 may not be good and the charging film 40 may have handling problems. If the charging film 40 is too thick, the distance between the cathode electrode 16 and the anode electrode 20, i.e., the width d of the slit is not small. Therefore, sufficient electric field for emitting electrons may not be generated. In the first embodiment, the thickness t1 of the charging film 40 is 45 μm.

The charging film 40 is made of a piezoelectric material, an electrostrictive material, an anti-ferroelectric material, or a material having a low dielectric constant. For example, $SiO_2$, or a metal oxide film such as MgO, or a glass may be used as the material having a low dielectric constant. Alternatively, the charging film 40 may be made of the same dielectric material as that of the emitter section 14.

Figure 10:
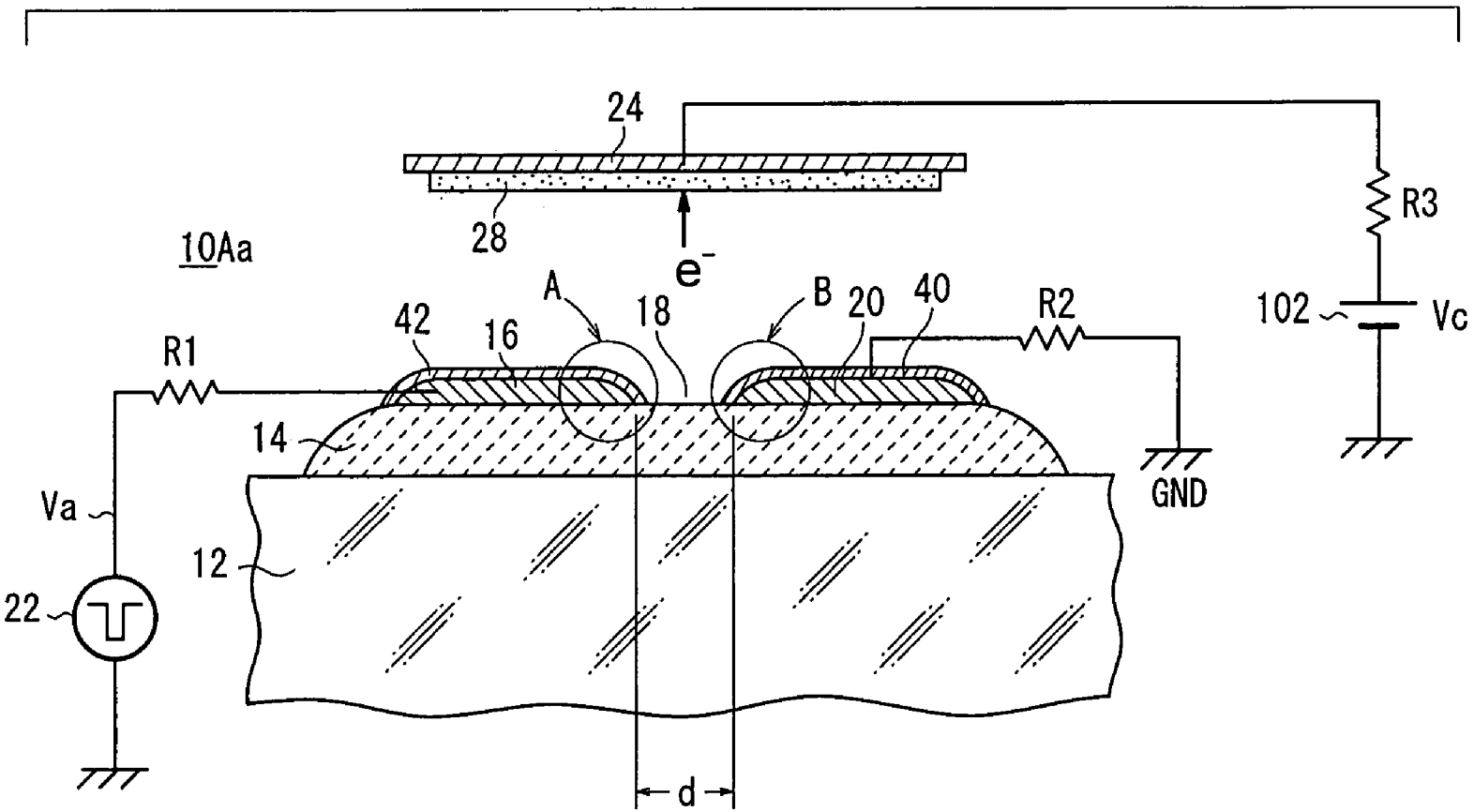
FIG. 10 is a view showing a modification of the electron emitter according to the first embodiment.

FIG. 10 is a view showing an electron emitter 10Aa in a modification. The electron emitter 10Aa includes a protective film 42 formed on the surface of the cathode electrode 16. The protective film 42 may be formed on the same material as that of the charging film 40. The protective film 42 may be made of an insulator or a highly resistive conductor having a low sputtering yield and a high evaporation temperature in vacuum.

Preferably, the protective film 42 has a thickness in the range of 10 nm to 100 nm. If the protective film 42 is too thin, durability of the protective film 42 may not be good and the protective film 42 may have handling problems. If the protective film 42 is too thick, the electrons emitted from the electric field concentration point A or the interface between the cathode electrode 16 and the emitter section 14 may not pass through the protective film 42. The protective film 42 may be made of the same material as the charging film 40. Thus, the charging film 40 and the protective film 42 can be formed in a single process, and the fabrication process is simplified.

The pattern or the potential of the collector electrode 24 may be changed suitably depending on the application. If a control electrode (not shown) or the like is provided between the emitter section 14 and the collector electrode 24 for arbitrarily setting the electric field distribution between the emitter section 14 and the collector electrode 24, the emission path of the emitted secondary electrons can be controlled easily. Thus, it is possible to change the size of the electron beam by converging and expanding the electron beam, and to change the shape of the electron beam easily.

As described above, the electron source emitting a straight electron beam is produced, and the emission path of emitted secondary electrons is controlled easily. Therefore, the electron emitter 10A according to the first embodiment can be utilized advantageously as a pixel of a display with an aim to decrease the pitch between the pixels.

Next, an electron emitter 10B according to a second embodiment will be described with reference to FIG. 11.

Figure 11:
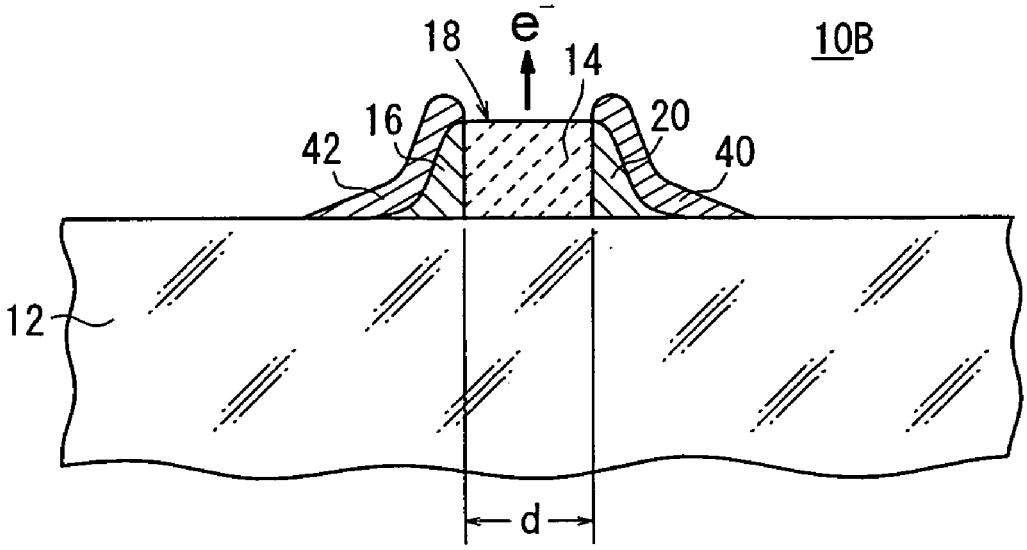
FIG. 11 is a view showing main components of an electron emitter according to a second embodiment.

As shown in FIG. 11, the electron emitter 10B according to the second embodiment includes an emitter section 14 having a width d in the range of 0.1 to 50 μm. A cathode electrode 16 is formed on one side of the emitter section 14, and an anode electrode 20 is formed on the other side of the emitter section 14. The emitter section 14 is formed in a slit 18 between the cathode electrode 16 and the anode electrode 20, and the emitter section 14 is sandwiched between the cathode electrode 16 and the anode electrode 20.

As with the first embodiment, a charging film 40 is formed on the surface of the anode electrode 20. As shown in FIG. 11, a protective film 42 may be formed on the cathode electrode 16.

In the electron emitter 10B according to the second embodiment, as with the electron emitter 10A according to the first embodiment, damage to the cathode electrode 16 is prevented. Since the emitter section 14 is made of a dielectric material, and sandwiched between the cathode electrode 16 and the anode electrode 20, the polarization in the emitter section 14 is carded out completely, and the electron emission by the polarization reversal can be performed stably and efficiently.

Next, three modifications of the electron emitter 10B according to the second embodiment will be described with reference to FIGS. 12 to 16.

Figure 12:
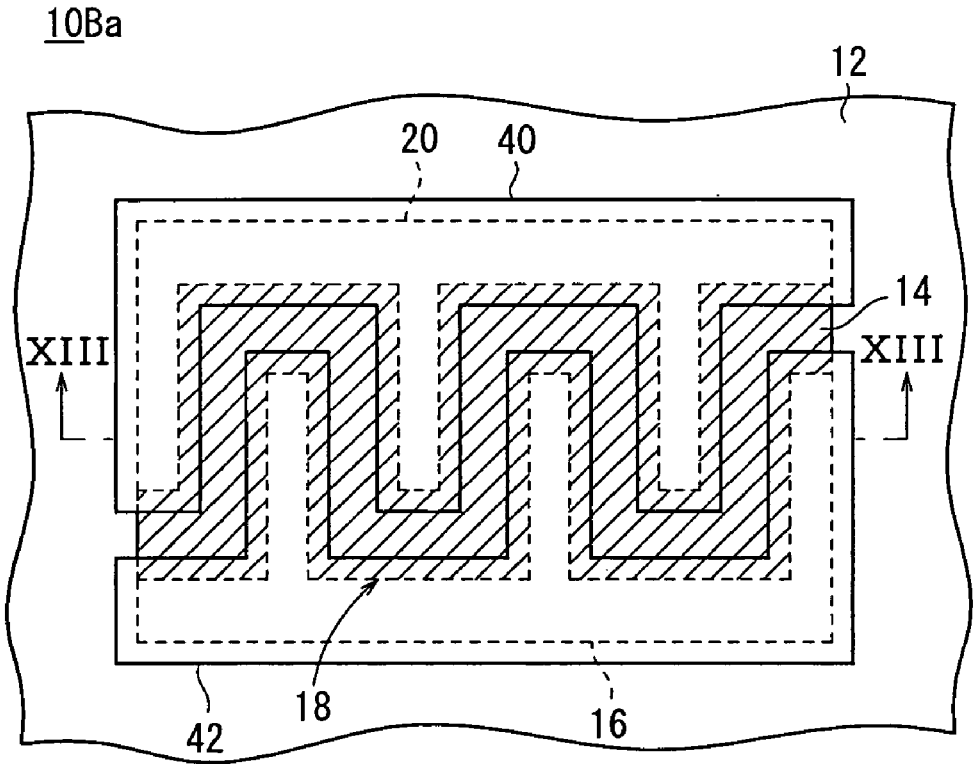
FIG. 12 is a plan view showing a first modification of the electron emitter according to the second embodiment.
Figure 13:
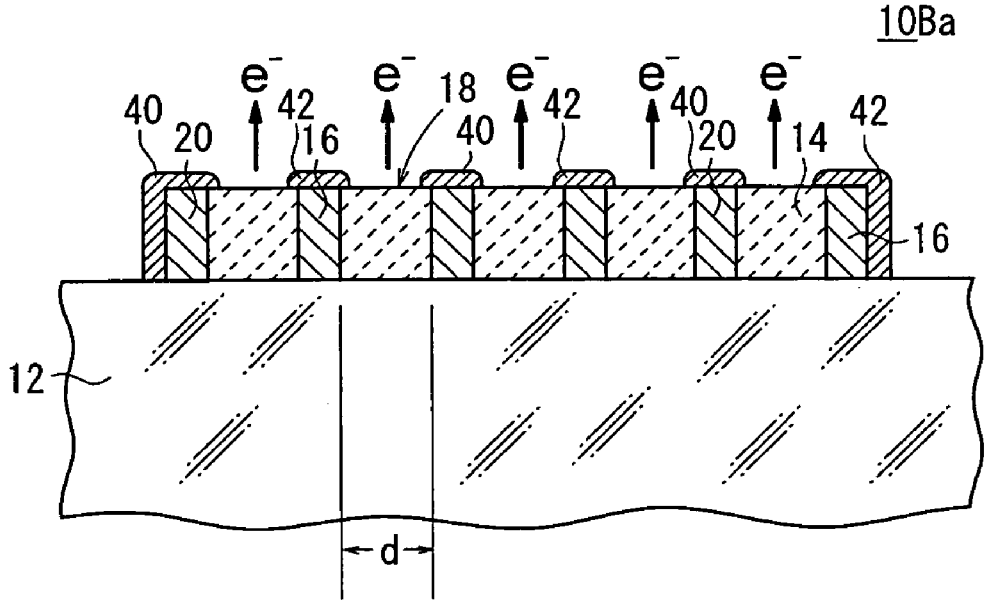
FIG. 13 is a cross sectional view taken along a line XIII—XIII shown in FIG. 12.

The electron emitter 10Ba in the first modification is based on the same concept as the electron emitter 10B according to the second embodiment, but differs from the electron emitter 10B in that the emitter section 14 is formed in a tortuous pattern in a plan view, as shown in FIGS. 12 and 13.

If the emitter section 14 is formed in a tortuous pattern, the area of contact between the cathode electrode 16 and the emitter section 14 and the area of contact between the anode electrode 20 and the emitter section 14 are increased for efficiently emitting electrons. Also in this modification, a charging film 40 is formed on the surface of the anode electrode 20. As shown in FIGS. 12 and 13, a protective film 42 may be formed on the cathode electrode 16.

Figure 14:
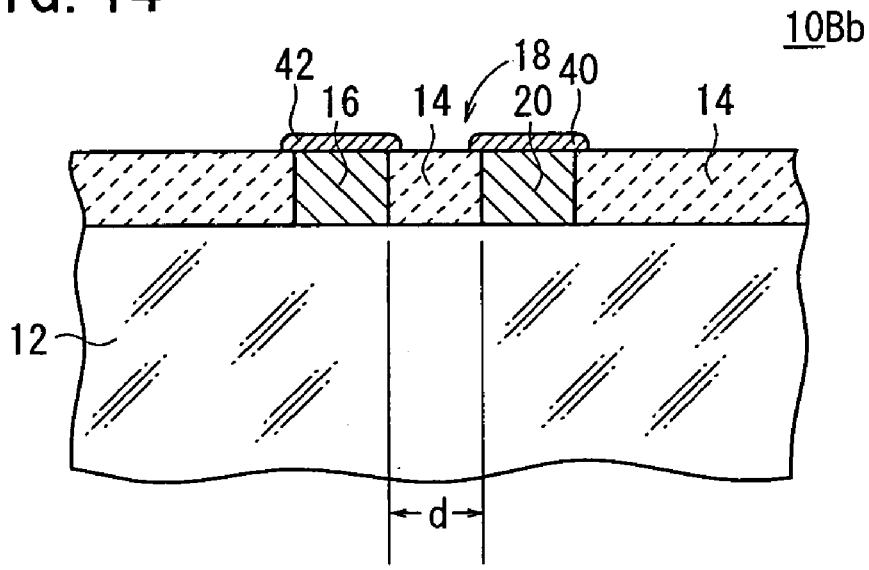
FIG. 14 is a cross sectional view showing a second modification of the electron emitter according to the second embodiment.

As shown in FIG. 14, an electron emitter 10Bb according a second modification has an emitter section 14 made of a dielectric material on the substrate 12, and a cathode electrode 16 and an anode electrode 20 which are embedded in windows defined in the emitter section 14. The cross-sectional areas of the cathode electrode 16 and the anode electrode 20 are thus increased to reduce the resistance of the cathode electrode 16 and the anode electrode 20 for suppressing the generation of the Joule heat. That is, the cathode electrode 16 and the anode electrode 20 can be protected. Also in this modification, a charging film 40 is formed on the surface of the anode electrode 20. As shown in FIG. 14, a protective film 42 may be formed on the cathode electrode 16.

Figure 15:
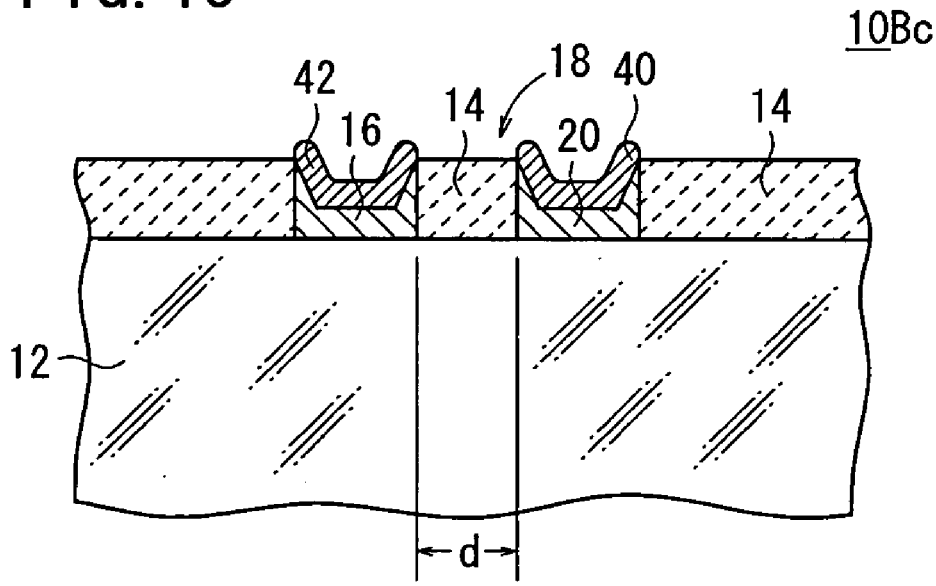
FIG. 15 is a cross sectional view showing a third modification of the electron emitter according to the second embodiment.
Figure 16:
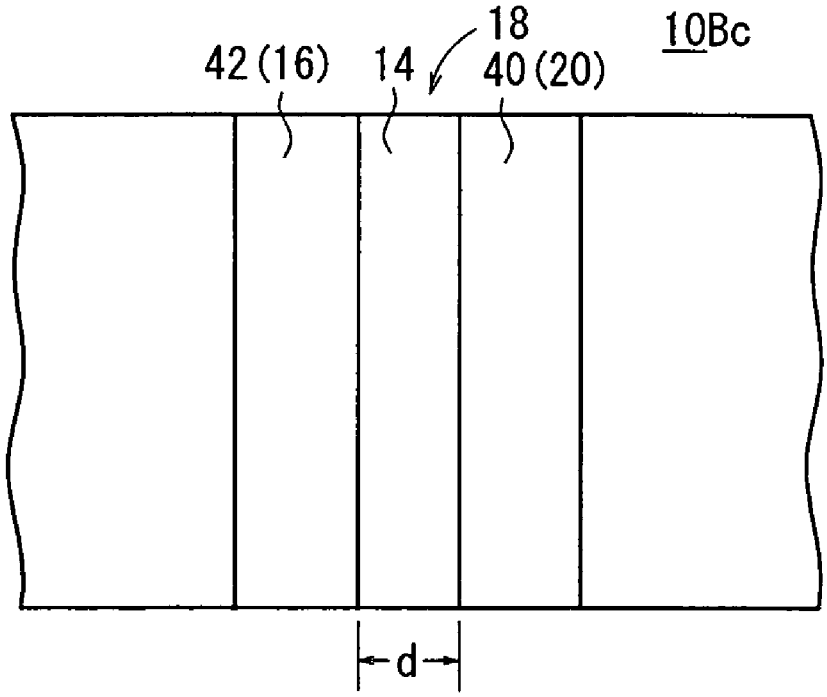
FIG. 16 is a plan view showing the third modification of the electron emitter according to the second embodiment.

In the second modification, the thickness of the cathode electrode 16 and the thickness of the anode electrode 20 are the saint as the thickness of the emitter section 14. In an electron emitter 10Bc according to a third modification, the thickness of the cathode electrode 16, and the thickness of the anode electrode 20 are thinner than the thickness of the emitter section 14 as shown in FIGS. 15 and 16. As with the electron emitter 10B according to the second embodiment shown in FIG. 11, the cathode electrode 16 and the anode electrode 20 are formed in contact with side walls of the emitter section 14 in the slit 18. Also in this modification, a charging film 40 is formed on the surface of the anode electrode 20. As shown in FIG. 15, a protective film 42 may be formed on the cathode electrode 16.

In the third modification, the amount of metals needed for the cathode electrode 16 and the anode electrode 20 is small as with the first modification. Therefore, a precious metal such as platinum or gold can be used as a material forming the cathode electrode 16 and the anode electrode 20, and the characteristics of the electrodes are improved.

In the electron emitters 10A and 10B according to the first and second embodiments (including the modifications), the collector electrode 24 is coated with the fluorescent layer 28 for use as a pixel of a display. The displays of the electron emitters 10A and 10B offer the following advantages:

(1) The displays can be thinner (the panel thickness= several mm) than CRTs.

(2) Since the displays emit natural light from the fluorescent layer 28, they can provide a wide angle of view which is about 180° unlike LCDs (liquid crystal displays) and LEDs (light-emitting diodes).

(3) Since the displays employ a surface electron source, they produce less image distortions than CRTs.

(4) The displays can respond more quickly than LCDs, and can display moving images free of after image with a high-speed response on the order of μsec.

(5) The displays consume an electric power of about 100 W in terms of a 40-inch size, and hence is characterized by lower power consumption than CRTs, PDPs (plasma displays), LCDs, and LEDs.

(6) The displays have a wider operating temperature range (−40 to +85° C.) than PDPs and LCDs. LCDs have lower response speeds at lower temperatures.

(7) The displays can produce higher luminance than conventional FED displays as the fluorescent material can be excited by a large current output.

(8) The displays can be driven at a lower voltage than conventional FED displays because the drive voltage can be controlled by the polarization reversing characteristics and film thickness of the piezoelectric material.

Because of the above various advantages, the displays can be used in a variety of applications described below.

(1) Since the displays can produce higher luminance and consume lower electric power, they are optimum for use as 30- through 60-inch displays for home use (television and home theaters) and public use (waiting rooms, karaoke rooms, etc.).

(2) Inasmuch as the displays can produce higher luminance, can provide large screen sizes, can display full-color images, and can display high-definition images, they are optimum for use as horizontally or vertically long, specially shaped displays, displays in exhibitions, and message boards for information guides.

(3) Because the displays can provide a wider angle of view due to higher luminance and fluorescent excitation, and can be operated in a wider operating temperature range due to vacuum modularization thereof, they are optimum for use as displays on vehicles. Displays for use on vehicles need to have a horizontally long 8-inch size whose horizontal and vertical lengths have a ratio of 15:9 (pixel pitch=0.14 mm), an operating temperature in the range from −30 to +85° C., and a luminance level ranging from 500 to 600 cd/m$^2$ in an oblique direction.

Because of the above various advantages, the electron emitters can be used as a variety of light sources described below.

(1) Since the electron emitters can produce higher luminance and consume lower electric power, they are optimum for use as projector light sources which are required to have a luminance level of 200 lumens.

(2) Because the electron emitters can easily provide a high-luminance two-dimensional array light source, can be operated in a wide temperature range, and have their light emission efficiency unchanged in outdoor environments, they are promising as an alternative to LEDs. For example, the electron emitters are optimum as an alternative to two-dimensional array LED modules for traffic signal devices. At 25° C. or higher, LEDs have an allowable current lowered and produce low luminance.

The electron emitter according to the present invention are not limited to the above embodiments, but may be embodied in various arrangement without departing from the scope of the present invention.

What is claimed is:

1. An electron emitter comprising:

an emitter section made of a dielectric material;

a first electrode formed in contact with said emitter section;

a second electrode formed in contact with said emitter section;

a slit formed between said first electrode and said second electrode;

a charging film formed at least on a surface of said second electrode; and means for inducing emission of electrons by polarization inversion from at least a portion of said emitter section which is exposed through said slit.

2. An electron emitter according to claim 1, wherein said emitter section is made of a piezoelectric material, an anti-ferroelectric material, or an electrostrictive material.

3. An electron emitter according to claim 1, wherein polarization reversal occurs in an electric field E applied to said emitter section represented by E=Vak/d, where d is a width of said slit, and Vak is a voltage applied between said first electrode and said second electrode.

4. An electron emitter according to claim 3, wherein said voltage Vak is less than a dielectric breakdown voltage of said emitter section.

5. An electron emitter according to claim 3, wherein the width d of said slit is determined so that the voltage Vak applied between said first electrode and said second electrode has an absolute value of less than 100V.

6. An electron emitter according to claim 1, wherein said charging film is made of a piezoelectric material, an electrostrictive material, an anti-ferroelectric material, or a material having a low dielectric constant.

7. An electron emitter according to claim 6, wherein said material having a low dielectric constant is an oxide or a glass.

8. An electron emitter according to claim 1, wherein said charging film and said emitter section are made of a same dielectric material.

9. An electron emitter according to claim 1, wherein said charging film has a thickness in the range of 10 nm to 100 μm.

10. An electron emitter according to claim 1, wherein a protective film is formed on a surface of said first electrode.

11. An electron emitter according to claim 10, wherein said protective film and said charging film are made of a same material.

12. An electron emitter according to claim 10, wherein said protective film is made of an insulator or a highly resistive conductor having a low sputtering yield and a high evaporation temperature in vacuum.

13. An electron emitter according to claim 10, wherein said protective film has a thickness in the range of 10 nm to 100 μm.

14. An electron emitter according to claim 1, wherein said means for inducing emission of electrons applies a drive voltage between said first electrode and said second electrode and the change of the voltage applied between said first electrode and said second electrode at the time of electron emission is 20V or less.

15. An electron emitter according to claim 1, wherein said first electrode and said second electrode are formed on an upper surface of said emitter section, and said slit is a gap.

16. An electron emitter according to claim 1, wherein said first electrode is formed in contact with one side of said emitter section, said second electrode is formed in contact with the other side of said emitter section, and said emitter section is formed in said slit.

17. An electron emitter according to claim 16, wherein said emitter section is formed in a tortuous pattern.

18. An electron emitter according to claim 16, wherein said emitter section is provided on an upper surface of a substrate;

said first electrode is formed in contact with one side of said emitter section;

said second electrode is formed in contact with the other side of said emitter section;

said emitter section is formed in said slit;

a third electrode is provided above said substrate; and said third electrode is coated with a fluorescent layer.

19. An electron emitter according to claim 1, wherein a drive voltage is applied between said first electrode and said second electrode such that said first electrode has a potential lower than a potential of said second electrode to reverse polarization of at least a portion of said emitter section which is exposed through said slit; and the polarization reversal causes emission of electrons in the vicinity of said first electrode.

20. An electron emitter according to claim 1, wherein a drive voltage is applied between said first electrode and said second electrode to reverse polarization of a portion of said emitter section which is exposed through said slit;

the polarization reversal causes positive poles of dipole moments in the vicinity of said first electrode to be oriented toward said first electrode, inducing emission of primary electrons from said first electrode; and said emitted primary electrons impinge upon said emitter section to induce emission of secondary electrons from said emitter section.

21. An electron emitter according to claim 20, wherein said first electrode, a portion of said emitter section which is exposed through said slit, and a vacuum atmosphere define a triple point; and primary electrons are emitted from a portion of said first electrode in the vicinity of said triple point, and said emitted primary electrons impinge upon said emitter section to induce emission of secondary electrons from said emitter section.

22. An electron emitter according to claim 1, wherein a third electrode is provided above said emitter section at least at a portion facing said slit, and said third electrode is coated with a fluorescent layer.

* * * * *